US006323818B1

(12) United States Patent
Koh et al.

(10) Patent No.: US 6,323,818 B1
(45) Date of Patent: Nov. 27, 2001

(54) INTEGRATION OF HOLLOW WAVEGUIDES, CHANNELS AND HORNS BY LITHOGRAPHIC AND ETCHING TECHNIQUES

(75) Inventors: Philip J. Koh, Charlottesville; Thomas W. Crowe, Palmyra; William L. Bishop, Jr., Charlottesville; Jeffrey L. Hesler, Charlottesville; Robert M. Weikle, Charlottesville, all of VA (US); Chris Mann; David Matheson, both of Oxon (GB)

(73) Assignee: University of Virginia Patent Foundation, Charlottesville, VA (US)

( * ) Notice: Subject to any disclaimer, the term of this patent is extended or adjusted under 35 U.S.C. 154(b) by 0 days.

(21) Appl. No.: 09/381,744

(22) PCT Filed: Mar. 25, 1998

(86) PCT No.: PCT/US98/05828

§ 371 Date: Apr. 6, 2000

§ 102(e) Date: Apr. 6, 2000

(87) PCT Pub. No.: WO98/43314

PCT Pub. Date: Oct. 1, 1998

Related U.S. Application Data

(60) Provisional application No. 60/041,668, filed on Mar. 25, 1997.

(51) Int. Cl.[7] ..... H01Q 1/38

(52) U.S. Cl. ..... 343/786; 343/772

(58) Field of Search ..... 343/786, 772, 343/767, 700 MS, 789, 810, 795

(56) References Cited

U.S. PATENT DOCUMENTS

| | | | | |
|---|---|---|---|---|
| 4,370,659 | * | 1/1983 | Chu et al. | 343/772 |
| 4,527,165 | | 7/1985 | de Ronde . | |
| 4,757,324 | * | 7/1988 | Dhanjal | 343/776 |
| 4,888,597 | | 12/1989 | Rebiez et al. . | |
| 6,008,770 | * | 12/1999 | Sugawara | 343/767 |

* cited by examiner

*Primary Examiner*—Don Wong
*Assistant Examiner*—James Clinger
(74) *Attorney, Agent, or Firm*—Miles & Stockbridge P.C.

(57) ABSTRACT

A millimeter or submillimeter wavelength device including a substrate (2) having a horn shaped cavity (18), and first and second extension layers formed on a top surface of the substrate adjacent to the horn shaped cavity. The first and second extension layers define additional opposed sides of the horn shaped cavity, channels, and walls of the waveguide. Internal surfaces of the horn shaped cavity, the channels, and the waveguide walls include a conductive layer. Two such structures, which are mirror images of each other, are joined to form a horn antenna with integrated channels and a waveguide. The device is fabricated by forming a resist layer on a substrate which includes a horn shaped cavity. The resist layer is etched to form a half horn antenna, channels and walls of a waveguide. Internal surfaces of the half horn antenna, the channels, and the walls of the waveguide are then metalized. Two such metalized structures are then joined to form a full horn antenna integrated with channels and a waveguide.

52 Claims, 6 Drawing Sheets

INTEGRATION OF HOLLOW WAVEGUIDES, CHANNELS AND HORNS BY LITHOGRAPHIC AND ETCHING TECHNIQUES

This application is a 317 of PCT/US98/05828 filed Mar. 25, 1998, which claims benefit of Prov. No. 60/041,668 filed Mar. 25, 1997.

CROSS REFERENCES TO RELATED APPLICATIONS

This application is related to U.S. Provisional Application No. 60/041,669 by Koh et al entitled "A PREFERENTIAL CRYSTAL ETCHING TECHNIQUE FOR THE FABRICATION OF MILLIMETER AND SUBMILLIMETER WAVELENGTH HORN ANTENNAS" filed Mar. 25, 1997, and U.S. Provisional Application No. 60/042,065 by Bishop et al entitled "REPRODUCTION OF MILLIMETER AND SUBMILLIMETER WAVELENGTH HOLLOW WAVEGUIDES, CHANNELS, HORNS AND ASSEMBLIES BY CASTING/MOLDING TECHNIQUES" filed Mar. 25, 1997, both of which are incorporated herein by reference.

BACKGROUND OF THE INVENTION

1. Field of the Invention

This invention relates to the fabrication of millimeter and submillimeter wavelength devices, and more particularly the fabrication of millimeter and sub-millimeter wavelength horn antennas integrated with waveguides, channels, and other components using lithographic and etching techniques.

2. Discussion of Background

In general terms, an electromagnetic waveguide is any structure which is capable of confining and guiding electromagnetic energy from one point to another in a circuit. A variety of structures have been devised to accomplish this goal. For example, coplanar waveguide is a type of waveguide which consists of thin strips of coplanar conductive material on a dielectric substrate. Another example is dielectric waveguide in which the radiation is confined in a coaxial dielectric tube by the principle of total internal reflection. A hollow metal electromagnetic waveguide is an electrically conductive hollow tube or pipe-like structure or a collection of such structures designed to confine and guide electromagnetic radiation. A horn is a tapered or flared waveguide structure which couples energy to or from free space and concentrates the energy within a defined spatial distribution (beam pattern). Only the inside surface of these structures must be conductive as the major fraction of the electrical current is constrained by nature to flow within a thickness known as the skin depth which is directly related to wavelength. Also the inner dimensions of such waveguides are determined by the radiation wavelength and are also generally proportional to wavelength.

Because of these relationships, the fabrication and design of hollow waveguides is strongly dependent on the operating wavelength. For example, in the case of microwaves with wavelengths on the order of centimeters, hollow waveguides can be easily fabricated by the extrusion of rectangular metallic tubes which have inside dimensions on the order of centimeters. Injection molded or extruded plastic waveguide components are also typically easily made for microwave wavelengths if they are coated with a sufficiently thick conductive material on internal surfaces. Also waveguide components for microwave frequencies can be made in sections which are joined by flanges and alignment is typically not difficult because of the relatively large dimensions.

However, the fabrication of hollow waveguide assemblies for millimeter and submillimeter wavelengths is typically much more difficult because the dimensions are correspondingly smaller. Also assemblies and subassemblies of waveguides must be combined with active electronic devices such as diodes or transistors and other passive components and circuits to make radio receiver and transmitter components such as heterodyne mixers. Therefore a complex network of accurately aligned, interconnected and very small hollow metal channels must be made and some of these channels must hold active and passive electronic components. This is generally not feasible with microwave style tubing.

A waveguide assembly designed for millimeter and submillimeter wavelengths is traditionally made by fabricating two machined metal "half" blocks, which when joined together, to form a structure comprised of air-filled metal channels. Because of RF electromagnetic field and current considerations, it is rare that any of the slots can typically be formed only in one half with the other half being a simple flat cover. Thus the blocks have slots of various shapes and sizes which are often the mirror image of each other and which require precise control of depth, width and position (i.e., alignment). This "split block" approach solves two basic problems: (1) the difficulty of monolithically forming complex and very small hollow metallic structures and (2) the need to insert a circuit deep within the structure.

In recent years high quality millimeter and submillimeter wavelength components have been manufactured using a technique based on direct machining of metal blocks, for example, as described by Siegel et al., "Measurements on a 215 GHz Subharmonically Pumped Waveguide Mixer Using Planar Back-to-Back Air-Bridge Schottky Diodes", IEEE Trans. Microwave Theory and Tech., Vol. MTT-41, No. 11, pp. 1913–1921, November 1993, and Blundell et al., "Submillimeter Receivers for Radio Astronomy", Proc. IEEE, Vol. 80, No. 11, pp. 1702–1720, November 1992. FIG. 7 of Blundell et al is a drawing of machined horn antenna and waveguide fabricated using the described technique. A horn antenna is commonly used to couple electromagnetic radiation into the waveguide in communications applications. The primary benefits of machining the waveguide and the horn antenna into the metal block are that it is a well understood process which gives the designer great flexibility, the final structure is robust, and all internal components, such as semiconductor diodes, are protected from the environment. In addition, the machining process is essentially three dimensional, and therefore allows the integration of electromagnetic horns of nearly arbitrary shape.

Although the above-described direct machining technique has gained wide industry acceptance, the expense of the required machining equipment, the personnel expertise, and the fabrication time greatly increase the cost of fabricating millimeter and submillimeter wavelength components. Also, as the desired operating frequency of the components is increased (i.e., wavelength is decreased), the required dimensions of the metal block features shrink proportionally in relation to the decrease in wavelength, making fabrication even more costly and difficult.

Another common technique for fabricating millimeter and submillimeter wavelength components is known as electroforming, for example, as described by Ellison et al., "Corrugated Feedhorns at Terahertz Frequencies-Preliminary Results", Fifth Intl. Space THz Tech. Symp., Ann Arbor, Mich., pp. 851–860, May 1994. In the electroforming technique, a metal mandrel is formed by high precision machining techniques and is then used as a metal core around which a second metal is deposited by electroplating. It is this second metal which eventually forms the hollow metal waveguide after the initial metal is chemically etched away. This technique is employed because it is often easier to machine the mandrel than the actual waveguide itself. Using this technique, components have been fabricated for frequencies up to 2.5 THz, however, the fabrication of the components is still costly and difficult.

Another technique for fabricating millimeter and submillimeter wavelength horn antennas is known as silicon micromachining, for example, as describe by Ali-Ahmad, "92 GHz Dual-Polarized Integrated Horn Antennas", IEEE Trans. Antennas and Prop., Vol. 39, pp. 820–825, July 1991, and Eleftheriades et al., "A 20 dB Quasi-Integrated Horn Antenna", IEEE Microwave and Guided Wave Letters, Vol. 2, pp. 73–75, February 1992, which are incorporated herein by reference. Using this technique, and as in the present invention, the horn antennas are fabricated using a preferential/selective wet etch and silicon wafers with a correct crystal orientation, such that the etch process proceeds very quickly in the vertical or (100) crystal plane direction but which virtually stops when the (111) crystal planes are. When the etch is carried to completion, only the (111) plane surfaces are exposed, and the result is a pyramidal shape etched into the silicon having a flare angle between two opposite sides of the pyramidal shape of about 70 degrees. Although the pyramidal shape etched into the silicon can be used to fabricate a horn antenna, the wide flare angle of 70 degrees causes the horn antenna to have an unacceptably poor directivity (i.e., the beam is very broad). To compensate for this problem, Eleftheriades et al teaches attaching external metal sections having much smaller flare angles to the micromachined horn antenna to increase directivity. However, since these additional sections need to be machined and aligned to the pyramidal shaped horns, much of the benefit of silicon micromachining is lost.

Using quasi-optical techniques, for example, as described by Rebeiz, "Millimeter-Wave and Terahertz Integrated Circuit Antennas", Proc. IEEE, Vol. 80, No. 11, pp. 1748–1770, November 1992, the need for waveguides and horn antennas is completely eliminated. Instead, a traditional antenna is used to couple free-space electromagnetic radiation directly to the microelectronic device in use. This techniques has not yet given as good results as is possible with machined waveguides and horns, and is not yet accepted by the millimeter and submillimeter wavelength community, usually because of a lack of mechanical robustness in devices fabricated using this technique, susceptibility to electromagnetic interference, and the relatively large size of quasi-optical components.

Another technique for fabricating communication components is, for example, monolithic microwave integrated circuit (MMIC) technology, for example, as described by Bahl, "Monolithic Microwave Integrated Circuit Based on GaAs MESFET Technology", in Compound Semiconductor Electronics, The Age of Maturity, Ed. M. Shur, World Scientific, pp. 175–208, 1996. MMIC technology uses fully planar processing to form circuitry on wafers with planar waveguides, such as microstrip or coplanar waveguide, rather than hollow metal waveguides. Although this technology is very useful for fabricating devices operating at microwave frequencies (i.e., typically less than 30 GHz), MMIC technology has not yet been useful for fabricating devices operating at frequencies above about 100 GHz. This technique suffers from high losses due to the properties of the substrate materials and the poor characteristics of planar antennas manufactured using this technique as compared to horn antennas manufactured using other techniques.

Techniques using photoresist formers to fabricate waveguides and horns, for example, as described by Treen et al, "Terahertz Metal Pipe Waveguides", Proc. 18th Intl. Conf. on IR and Millimeter Waves, pp. 470–471, September 1993, Brown et al, "Micromachining of Terahertz Waveguide Components with Integrated Active Devices", Proc. 19th Intl. Conf. on IR and Millimeter Waves, pp. 359–360, October 1994, and Lucyszyn et al, "0.1 THz Rectangular Waveguides on GaAs Semi-Insulating Substrate", Electronic Letters, Vol. 31, No. 9, pp. 721–722, April 1995. Techniques using photoresist formers to fabricate waveguides and horns take advantage of techniques developed by the silicon microelectronics industry. Using this technique, hollow metal waveguides and horns formed around appropriately shaped layers of photoresist have been fabricated. The benefit of this technique is that the processing and shaping of photoresist is a well developed technology which can be precisely controlled on large wafers, thereby allowing many structures to be manufactured simultaneously and thus reducing costs. Also, photolithographic techniques easily allow the precision necessary for waveguide structures at the highest frequencies envisioned. The primary problems with photoresist technology have been forming and processing tall enough photoresist structures cheaply and reliably, removing the thick photoresist from inside the waveguides, because most of the surface area of the resist is not exposed to the solvent but rather covered by the waveguide, and only horns that flare in one dimension are possible, because the horns are flat, resulting in waveguides and horns having poor beam quality.

A new class of photoresist, EPON SU-8, for example, as described by Lee et al., "Micromachining Applications of a High Resolution Ultrathick Photoresist", J. Vac. Sci. Technol. B13(6), pp. 3012–3016, November/December 1995, appears to have solved the first problem of forming and processing tall enough photoresist structures cheaply and reliably. A preferential etching technique, for example, as described in U.S. Provisional Application No. 60/041,669 filed Mar. 25, 1997, by Koh et al entitled "A Preferential Crystal Etching Technique for the Fabrication of Millimeter and Submillimeter Wavelength Horn Antennas", offers a solution to the remaining problems. Using this technique, a cavity is preferentially etched in a substrate through a mask opening and the horn length and flare angle $\theta_1$ are determined by a shape of the mask opening which is controlled by a photolithography process, and the etch depth is determined by the mask shape, rate of the etch, and the etch time.

The present invention takes advantage of the development of new photoresist materials which easily form features of the appropriate size and complexity, for example, as described by Lee et al above, and the development of micromachining techniques based on crystallographic etches which can form three dimension etched structures, for example, as described by Koh et al above, both of which are incorporated herein by reference, to allow fabrication of millimeter and sub-millimeter wavelength horn antennas integrated with waveguides, channels, and other components.

SUMMARY OF THE INVENTION

Accordingly, one object of this invention is to provide a new and improved method for the fabrication of millimeter and submillimeter wavelength structures which allows ease of fabrication.

Another object of the present invention to provide a method for the fabrication of millimeter and submillimeter wavelength horn antennas integrated with waveguides, channels, and other components.

It is yet another object of the present invention to provide a method for the fabrication of millimeter and submillimeter wavelength horn antennas having a horn aperture having six or eight sides.

It is yet a further object of the present invention to provide a new and improved millimeter or submillimeter wavelength device including a six or eight sided horn antenna.

It is yet a still further object of the present invention to provide a new and improved millimeter or submillimeter wavelength device including a horn antenna with a well defined shape optimized to produce a particular antenna beam pattern.

It is yet another further object of the present invention to provide a new and improved millimeter or submillimeter wavelength device including a horn antenna integrally coupled with a wave guide.

The above and other objects are achieved according to the present invention by providing a new and improved millimeter or submillimeter wavelength device including a substrate having a horn shaped cavity, and first and second extension layers formed on a top surface of the substrate adjacent to the horn shaped cavity. The first and second extension layers define additional opposed sides of the horn shaped cavity, channels, and walls of a waveguide. Internal surfaces of the horn shaped cavity, the channels, and the waveguide walls include a conductive layer. Two such structures, which are mirror images of each other, are joined to form a horn antenna with integrated channels and a waveguide. The device is fabricated by forming a resist layer on a substrate which includes a horn shaped cavity. The resist layer is etched to form a half horn antenna, channels and walls of a waveguide. Internal surfaces of the half horn antenna, the channels, and the walls of the waveguide are then metalized. Two such metalized structures are then joined to form a full horn antenna integrated with channels and a waveguide.

BRIEF DESCRIPTION OF THE DRAWINGS

A more complete appreciation of the invention and many of the attendant advantages thereof will be readily obtained as the same becomes better understood by reference to the following detailed descriptions when considered in connection with the accompanying drawings, wherein.

DESCRIPTION OF THE PREFERRED EMBODIMENTS

Figure 1:
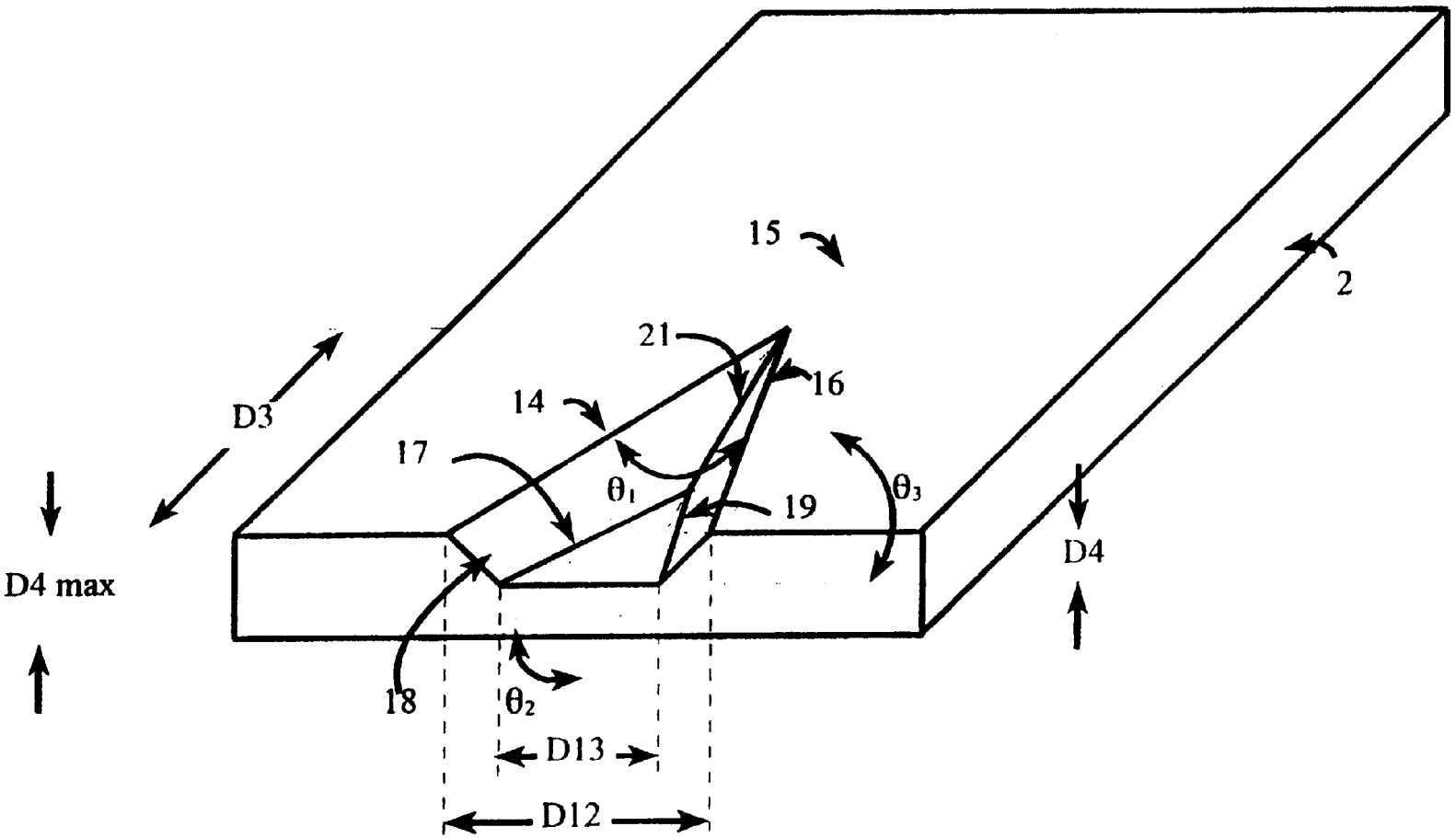
FIG. 1 is a top right perspective of a substrate with a cavity which will form a flared portion of an eight sided horn structure.

Referring now to the drawings, wherein like reference numerals designate identical or corresponding parts throughout the several views, and more particularly to FIG. 1 thereof, there is illustrated a crystalline substrate 2 with a cavity 18 defining a portion of a horn structure.

In FIG. 1, the cavity 18 has a horn flare angle $\theta_1$ between edges 14 and 16, a horn flare angle $\theta_2$ between line 15 which is parallel to the substrate 2 surface and edge 21, a face angle $\theta_3$ determined by the crystal properties (i.e., 54.7 degrees for silicon), a horn length D3, an etch depth D4, a maximum etch depth D4max, a horn widths D12 and D13. Note edges 17 and 14, and 19 and 16 are parallel to each other, respectively. According to the present invention $\theta_1$, D3 and D4 are variable depending on design criteria, with $D12=2\times D3\times\tan(\theta_1/2)$; $D4max=(D12/2)\times\tan(\theta_3)$; $\tan(\theta_2)=\tan(\theta_1/2)\times\tan(\theta_3)$; and $D13=D12-(2\times D4)/(\tan(\theta_3)$. Accordingly, the cavity 18 in the substrate 2 is of a specific and controllable shape, and may be formed, for example, using the previously described technique by Koh et al or any other suitable technique. Also, the shape of the cavity 18 need not be a pyramidal shape, but rather can take on any form desired by the horn designer, such as a stepped corrugated horn, or a horn with an increasing taper angle (i.e., like a trumpet). In addition, a photoresist material of variable thickness D5 is added as will be discussed with reference to FIG. 2, allowing further design flexibility in the design of the horn antenna aperture.

Next a layer of photoresist material (not shown) is applied to the substrate 2 which fills in the horn cavity 18 and planarizes the substrate 2 surface. For this purpose EPON SU-8 resist is used, for example, as described in Lee et al above, incorporated by reference herein. According to the present invention, a spin speed of 2000 rpm yields a planar surface having a thickness D5 of 215 microns above the silicon substrate 2, which is suitable for the present horn design. However, the thickness D5 can be varied based on a desired horn design by varying the spin speed. Standard photolithographic techniques are next used so that the portions of the photoresist outside of the horn and the desired waveguide areas are resistant to chemical etch. Either positive or negative resist processing is possible and, for example, SU-8 is used as a negative resist so that areas exposed to UV light are cross-linked and therefore not removed during the development step. Also, a post exposure bake at 100 degrees Celsius for fifteen minutes to further cross-link the exposed SU-8 areas is performed.

Next, the non-resistant regions of the resist are removed using a developer, such as propolene-glycol-monomethyl-ether-acetate (PGMEA) to develop the SU-8. According to the present invention, the use of EPON SU-8 resist is preferred in that it allows the thick (D5) resist layer to be formed and exposed with UV-light as compared to standard resists. However, any resist technology which yields suitable dimensions and hardness of the remaining layers can be employed.

Figure 2:
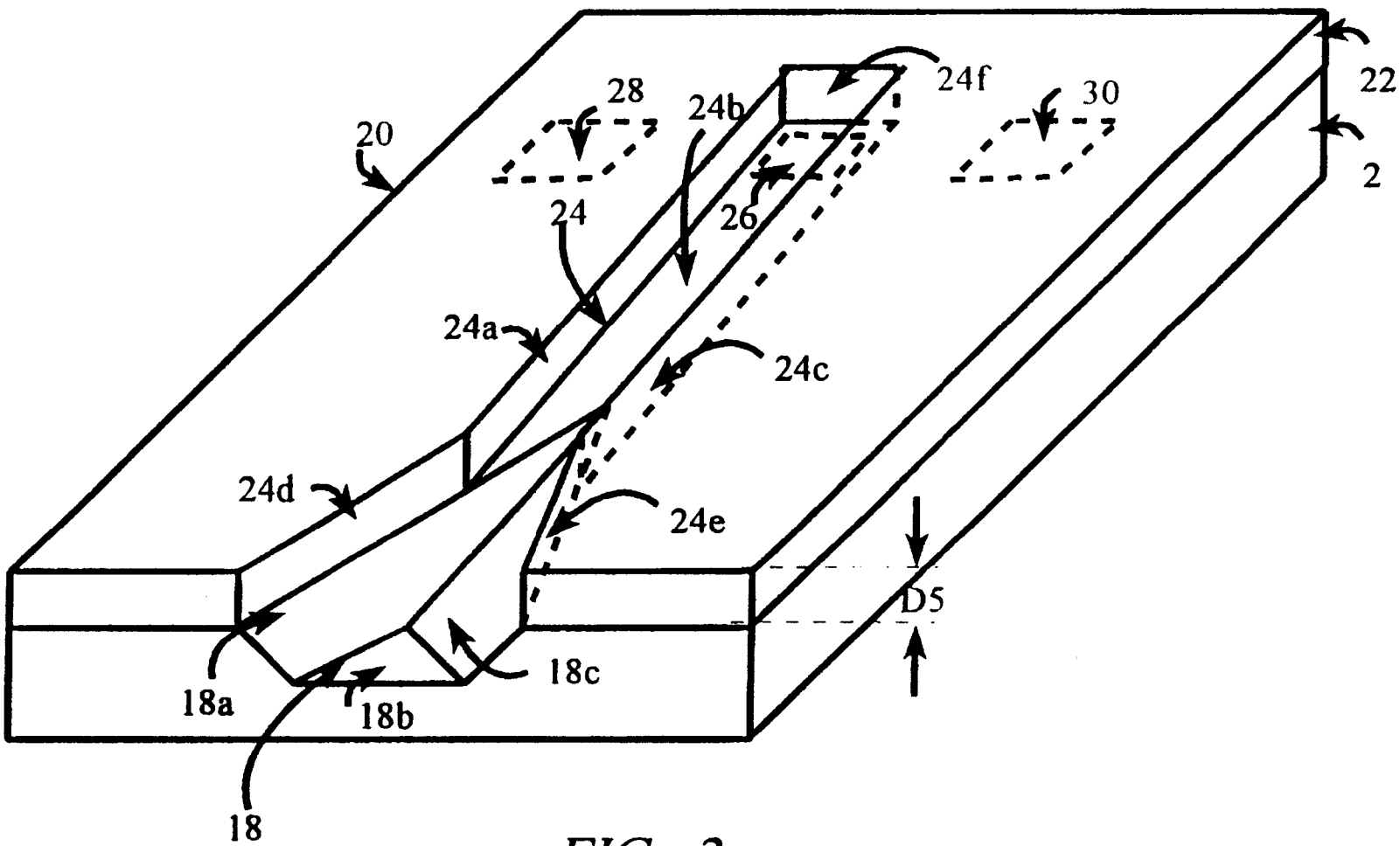
FIG. 2 is a top right perspective view showing a formation of part of rectangular waveguide on the structure of FIG. 1, according to the present invention.

In FIG. 2, after the non-resistant regions of the resist are removed, the remaining left and right resist portions 20 and 22 are cured, for example, at 100 degrees Celsius for a time sufficiently long to form a hardened plastic-like material. The entire sample is then coated with a conductive metalization layer (not shown), for example, sputtered gold, to form a highly conductive surface on internal surfaces 18*a*–18*c* of horn cavity 18, internal surfaces 24*a*–24*f* of the half rectangular waveguide 24, and the additional horn surfaces 24*d* and 24*e* of the resist portions 20 and 22, respectively. The thickness of the metalization layer need not be precisely controlled, but should typically be much greater than a skin depth at the desired frequency of operation of the device. Using sputtered gold, the thickness of the gold layer is about one micron. Other components 26, 28 and 30 are optionally formed in the substrate 2, and/or the resist portions 20 and 22, respectively, before or after adding the gold layer, resulting in a structure according to the present invention as shown in FIG. 2.

Figures 3A, 3B:
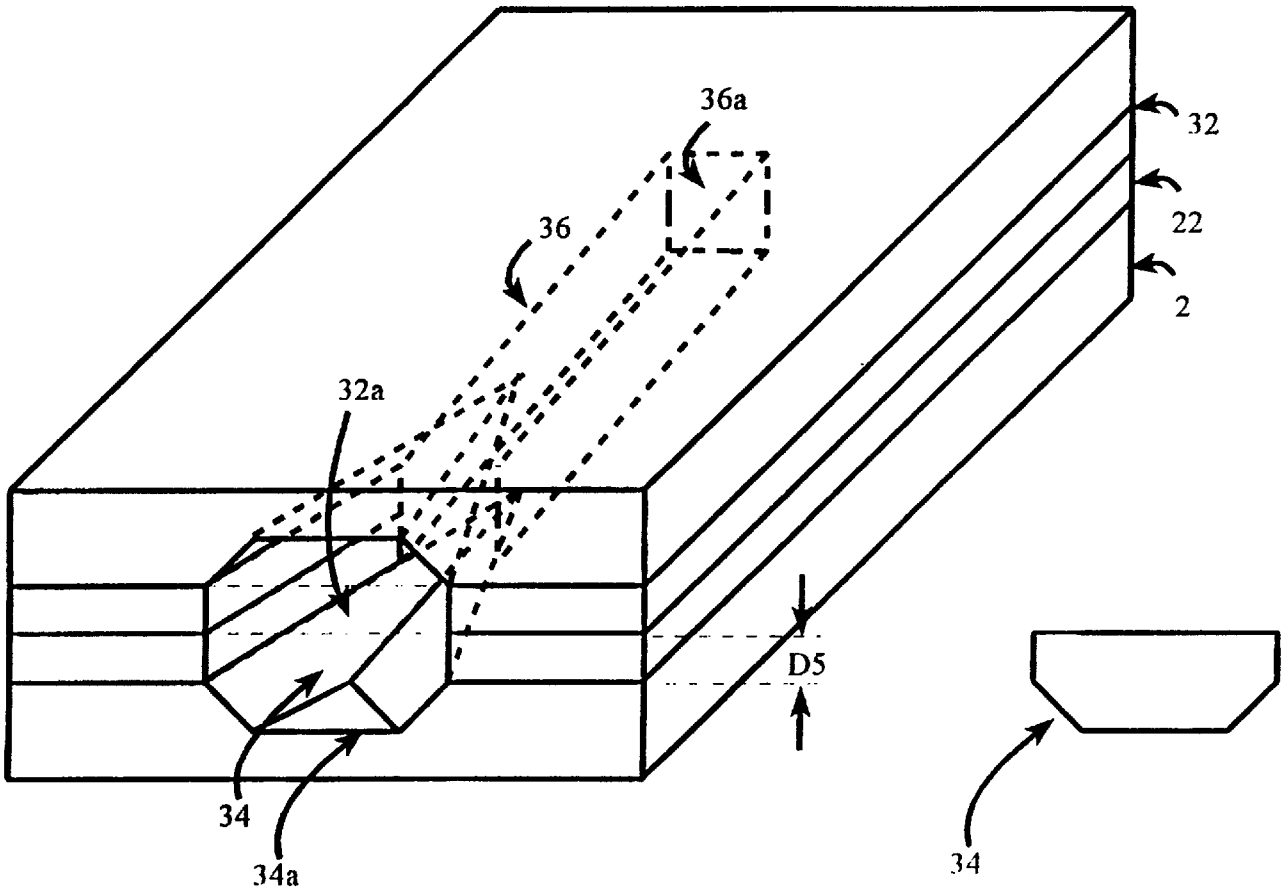
FIG. 3 is a top right perspective view showing a completed waveguide structure having an eight sided horn aperture formed by placing a structure which is a mirror image of the structure of FIG. 1 together with the structure of FIG. 2, according to the present invention.

In FIG. 3*a,* a structure 32 which is a mirror image of the structure of FIG. 2 is aligned and placed together with the structure of FIG. 3*a,* the result is a well formed, electromagnetic full horn antenna 34 having an eight sided output aperture 34*a* leading to a hollow metal waveguide 36 having an input aperture 36*a.* Alternately, a metalized plane 32*a* could be added instead of the mirror image structure 32, resulting in a half horn structure having a 6 sided output aperture 34, according to the present invention, as shown in FIG. 3*b.* Although the resulting half horn would have reduced symmetry due to its non-symmetrical shape as compared to the horn of FIG. 3*a,* the horn could be suitable for some applications where the symmetry of the beam is not critical. Other options for forming the device include using a flat wafer with a metalized surface for the top horn surface, or using subsequent processing steps to form the top horn structure, or possibly leaving the structure of FIG. 2 open.

Figure 4C:
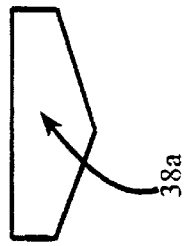
FIG. 4 is a top right perspective of the substrate of FIG. 1 after crystallographic etching to completion, showing a cavity which will form a flared portion of a six sided horn structure, according to the present invention.
Figure 4B:
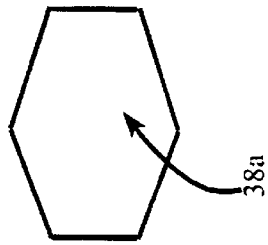
Figure 4A:
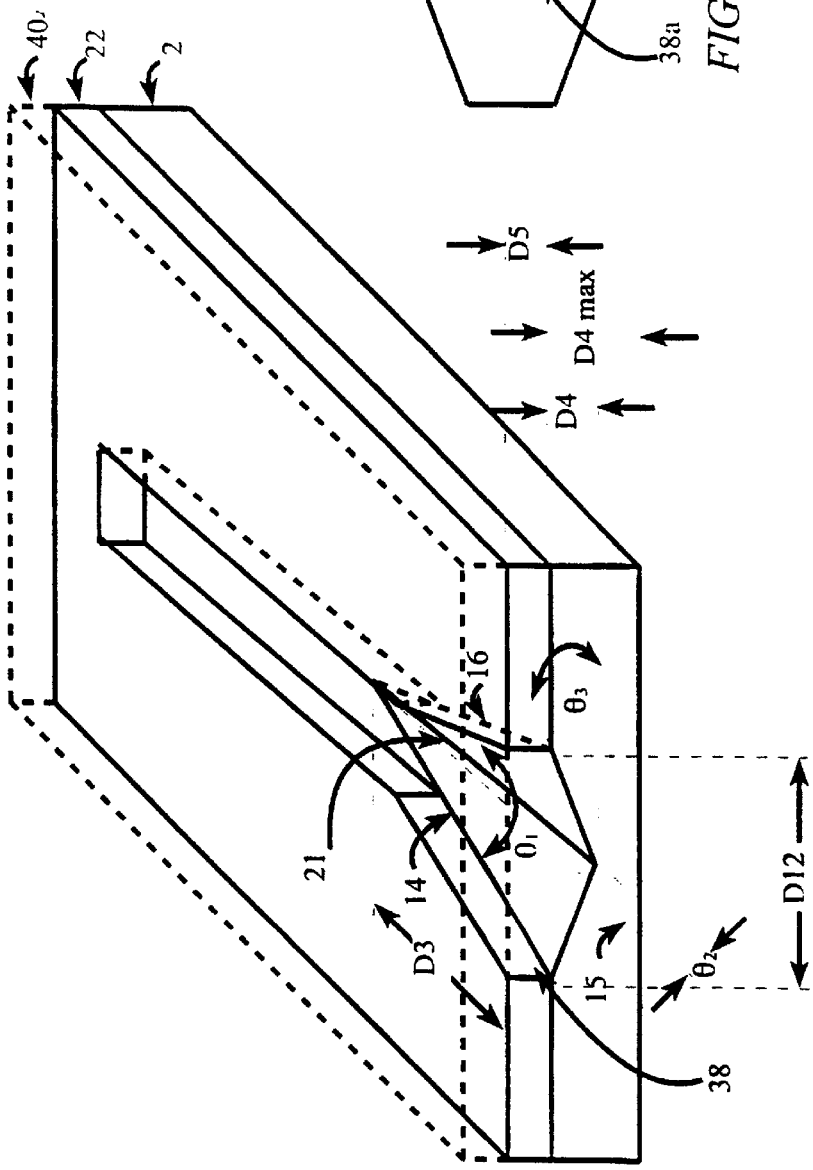

In FIG. 4*a,* a cavity 38 is used to fabricate a full horn structure having a six sided output aperture 38*a,* according to the present invention, as shown in FIG. 4*b.* The remaining processing would be the same as the processing required to fabricate the horn structure of FIG. 3*a,* except that two mirror image structures of FIG. 4*a* would be joined. Alternately, a metalized plane 40 could be added as shown in FIG. 4*a* instead of a mirror image structure, resulting in a half horn structure having a 5 sided output aperture 38*a,* according to the present invention, as shown in FIG. 4*c.* Although the resulting half horn would have reduced symmetry due to its non-symmetrical shape as compared to the horn of FIG. 4*b,* the horn could be suitable for some applications where the symmetry of the beam is not critical. The cavity 38 has a horn flare angle $\theta_1$ between edges 14 and 16, a horn flare angle $\theta_2$ between line 15 which is parallel to the substrate 2 surface and edge 21, a face angle $\theta_3$ determined by the crystal properties (i.e., 54.7 degrees for silicon), a horn length D3, an etch depth D4, a maximum etch depth D4max, a photoresist material 22 thickness D5, and horn width D12. According to the present invention $\theta_1$, D3 and D5 are variable depending on design criteria, D4 is fixed since the substrate 2 is etched to completion, with $D12=2\times D3\times\tan(\theta_1/2)$; $D4max=(D12/2)\times\tan(\theta_3)$; and $\tan(\theta_2)=\tan(\theta_1/2)\times\tan(\theta_3)$. Accordingly, the cavity 38 in the substrate 2 is of a specific and controllable shape, and may be formed, for example, using the previously described technique by Koh et al or any other suitable technique, allowing further design flexibility in the design of the horn antenna aperture.

Figure 5:
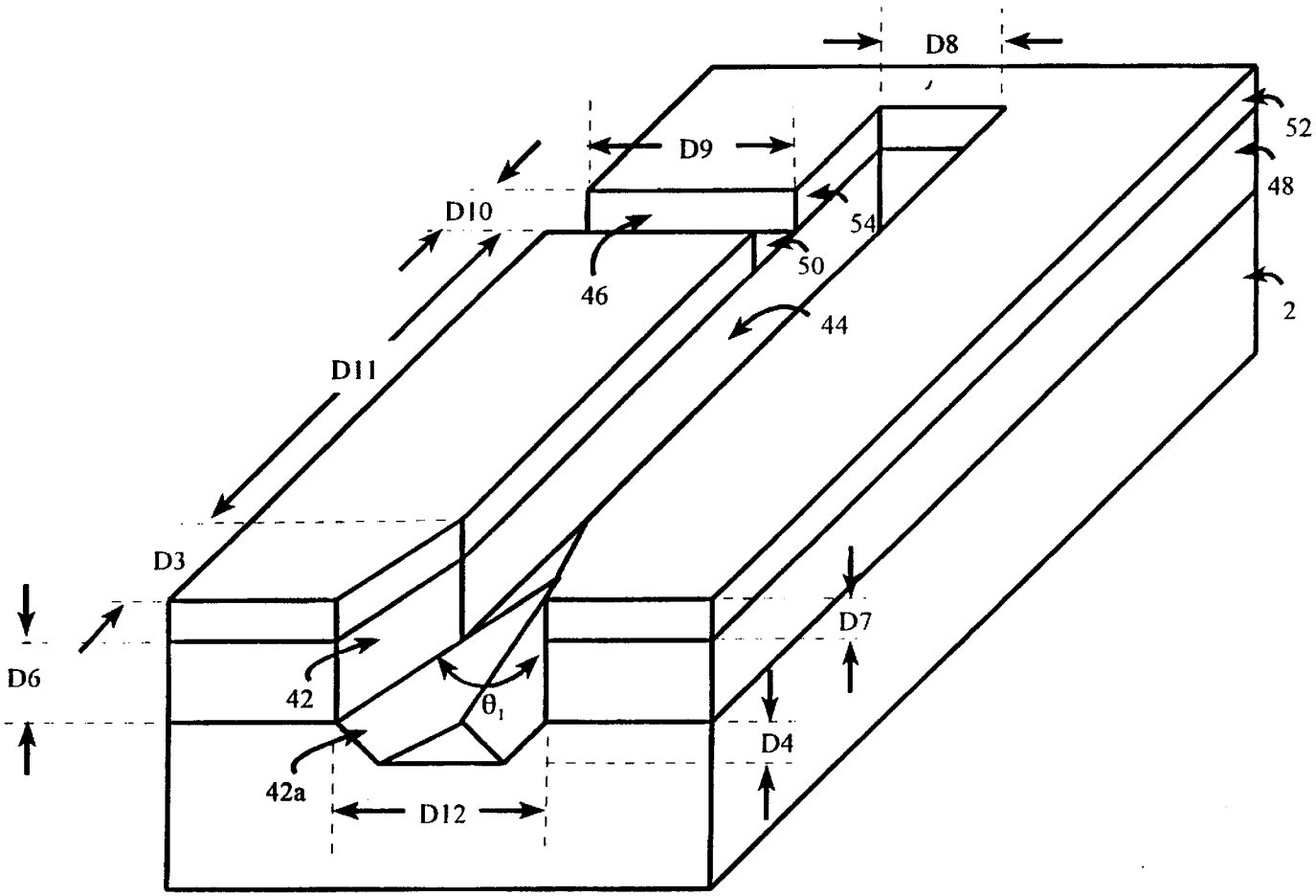
FIG. 5 is a top right perspective view showing a mixer block structure for use at 585 GHz, according to the present invention.

In addition to the fabrication of simple horns and waveguide sections, this process can be used to fabricate complete components, for example, such as a mixer block, as described by Hesler et al, "Fixed Tuned Submillimeter Wavelength Mixers Using Planar Schottky Barrier Diodes", IEEE Trans. Microwave Theory and Tech., Vol. 45, No. 5, May 1997, and incorporated herein by reference. In FIG. 5, in a 585 GHz mixer block, according to the present invention, there are three main components that must be microfabricated, the horn 42, the waveguide 44, and a microstrip channel 46 which is perpendicular to the waveguide 44. According to the present invention, the horn cavity 42*a* is first etched into the substrate 2. Then a first layer 48 of SU-8 is applied and photolithographically exposed to form the portion of the waveguide 50 which lies below the microstrip channel 46. However, this first layer 48 is not yet subjected to the post-exposure bake or development. Rather, a second layer 52 of SU-8 is first applied and exposed to form the remaining upper portion 54 of the waveguide and the microstrip channel 46. The post exposure bake and development are then applied to both layers 48 and 52 of SU-8, simultaneously forming both the waveguide 44 and the channel 46. According, to the present invention, the two SU-8 layers 48 and 52 were about 215 microns (D6) and 50 microns (D7) thick, the width D8 of the waveguide along the surface was about 200 microns and the total height of the two SU-8 layers 48 and 52 above the silicon surface was about 265 microns (D6+D7). The microstrip channel depth D9 was about 50 microns and the channel width D10 was about 140 microns. When two such pieces are fabricated as mirror images, metalized as described above and clamped together face to face, the final structure is a mixer block assembly equivalent to that of Hesler et al, as shown in FIG. 5, with a narrow flare angle horn 42, a standard rectangular waveguide 44 and a microstrip channel 46. The waveguide 44 from the horn 42 to the microstrip channel 46 extends a distance D11 of about 4.4 millimeters, the horn flare angle $\theta_1$ was 5.7 degrees, the horn length D3 was 15 millimeters, the horn width D12 was about 1.5 millimeters, and the etch depth D4 of the cavity 42*a* is about 580 microns. According to the present invention, all of these features are formed by standard microlithographic processes so that dimensions are easily controlled and varied to meet given design specifications. These dimension can be easily controlled to form a desired horn shape as will be discussed later with reference to FIG. 6. For example, the horn flare angle $\theta_1$ and the horn length D3 are equal to those of the original mask shape used to form the horn cavity, and the etch depth D4 can be varied by changing the etch time.

Figure 6:
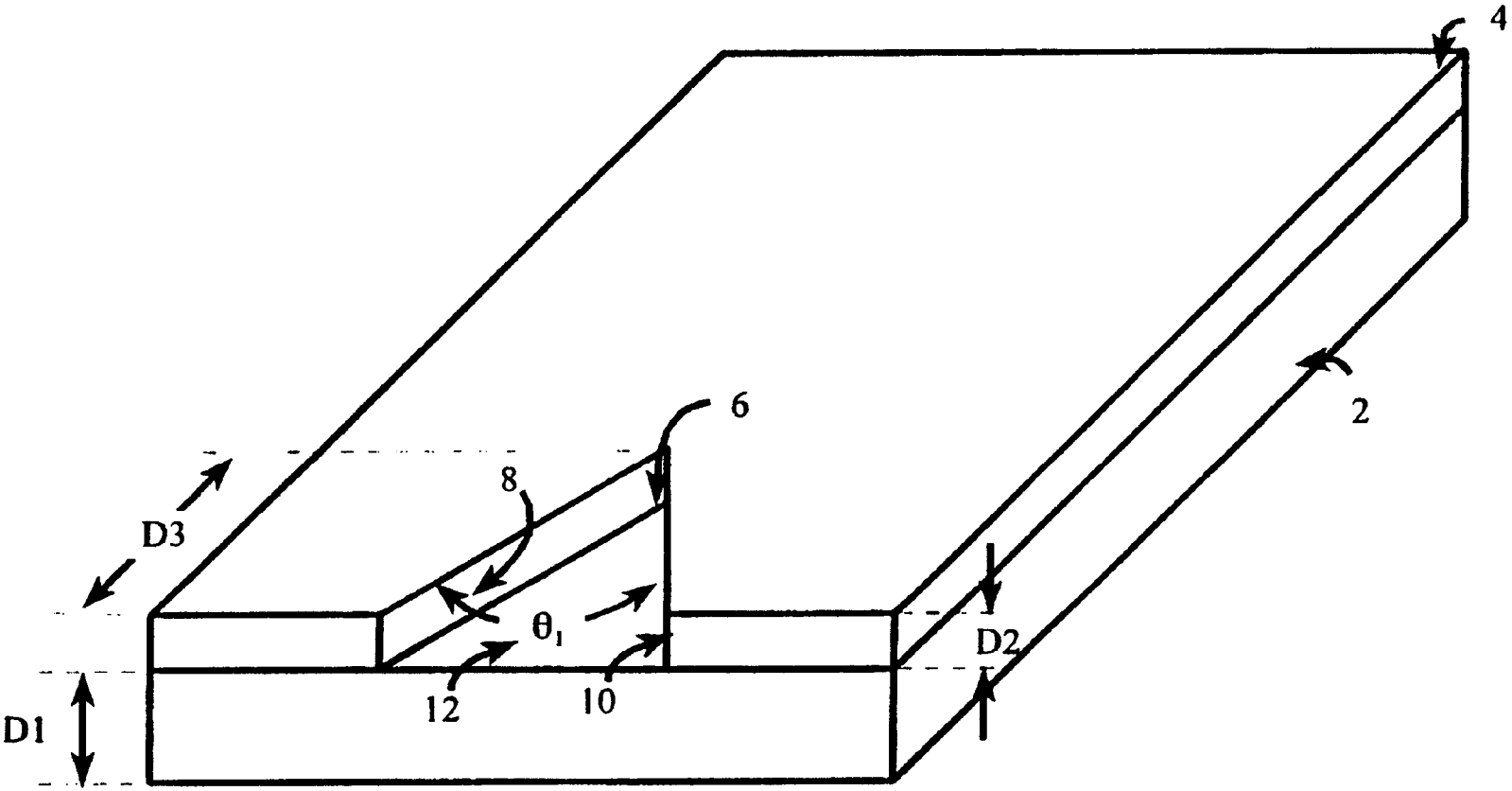
FIG. 6 is a top right perspective view a crystalline substrate with a mask whose shape defines an initial etch pattern for a horn structure.

According to the technique of the present invention, complete components may be fabricated in a substrate, such as those described in Siegel et al, Blundell et al, and Hesler et al, and any similar components design, without complicated machining of parts. In addition, techniques for micromachining silicon, for example, as described by Koh et al or other techniques may be used to form horn cavities in the substrate. For example, a suitable crystalline substrate 2, such as silicon, having a thickness D1 has an etch mask layer 4 having a mask opening 6, an opening angle $\theta_1$ between edges 8 and 10, a thickness D2, and a length D3 formed or deposited on the surface of the substrate 2 and processed in such a way as to expose a section of the substrate surface 12. The mask 4 is, for example, thermally grown silicon-dioxide (SiO2) layers of about one micron thickness (D2) as the mask material, however other standard materials such as silicon nitride and other deposition techniques such as chemical vapor deposition are equally useful. The SiO2 is then patterned by standard lithographic means and etched with buffered hydrofluoric acid (BHF) to form the mask opening 6 shown in FIG. 6. A horn flare angle $\theta_1$ and a horn length D3 are equal to those of the original mask shape used to form the cavity. Also, the etch depth D4 can be varied by changing the etch time, and the shape of the mask opening 6 need not be a simple linear taper as shown in FIG. 6, but rather can take on any form desired by the horn designer, such as a stepped corrugated horn, or a horn with an increasing taper angle (i.e., like a trumpet).

The precise shape of the resulting horn cavity can be calculated from the known properties of the etch or by empirical methods and the horn flare angle $\theta_1$, the horn length D3, and the etch depth D4 are controlled to generate the cavity. A crystallographic etch, such as, EDA-P (Ethylene Diamine-Pyrocatehol, trade name Transene PSE 300, Transene Co., Danvers, Mass. 01923) is then used to etch the substrate 2 through the mask opening 6 to form a desired horn cavity, such as a stepped corrugated horn, or a horn with an increasing taper angle (i.e., like a trumpet). In order to achieve a desired horn cavity, initial calibration of the etch as a function of temperature and etch strength is typically required. According to the present invention, the EDA-P at 115 degrees Celsius and an etch time of 330 minutes is used to obtain a 580 micron etch depth. The mask 4 is removed by a chemical etch, such as buffered hydrofluoric acid (BHF) to etch the SiO2.

According to the present invention, all fine features are formed through established lithographic techniques. Also, the present technique maintains the ability to form high quality electromagnetic horns which flare in two dimensions, for example. Furthermore, all of the processes can be carried out on large wafers, so that many components can be fabricated simultaneously using standard techniques, thus greatly reducing component cost. Additionally, active devices and circuit elements can be easily placed, formed or fabricated within the component.

Finally, components designed according to the present invention are easily formed by the process described herein. Also, the critical dimensions of the horn are easily controlled by the process (as previously described), and thus the beam pattern of the horn can be altered for specific applications. In addition to the structures shown and described, many other similar structures for a variety of applications can be fabricated according to the present invention. Also, additional circuit elements can be formed in the structure before the top structure 32 of FIG. 3*a* is added. For example, various techniques and/or processes can be used to form detector devices, filters, planar transmission lines and the like within or upon the substrate 2 and/or 32 shown in FIG. 3*a,* and/or the layers of hardened resist 20 and 22 shown in FIG. 2, and/or other materials may be deposited on the structure.

Although the present invention is described in terms of fabrication of millimeter and sub-millimeter wavelength horn antennas integrated with waveguides, channels, and other components using lithographic and etching techniques, it will be appreciated that alternative structures can also be fabricated by the present method such as oscillators, multipliers, amplifiers and detectors with active components formed integrally with the waveguide or other channel structures and, where necessary, with active components suspended within the channel structures formed on the wafer.

Obviously, numerous modifications and variations of the present invention are possible in light of the above teachings. It is therefore to be understood that within the scope of the appended claims, the invention may be practiced otherwise than as specifically described herein.

What is claimed is:

1. A millimeter or submillimeter wavelength device, comprising:

a first substrate including at least one first horn shaped cavity formed in a top surface of the first substrate and a first extension layer having first and second extension portions formed on the top surface of the first substrate adjacent to at least a portion of edges of said first horn shaped cavity; and a cover positioned opposite said first substrate to define a horn antenna having side walls including sides of said first horn shaped cavity, sides of said first and second extension portions of said first extension layer and said cover.

2. The device according to claim 1, wherein said cover comprises:

a second substrate having at least one second horn shaped cavity, which is a mirror image of the first horn shaped cavity, formed in a top surface of the second substrate;

wherein the second horn shaped cavity is disposed opposite the first horn shaped cavity with said first and second extension portions interposed therebetween to form said horn antenna having sides including sides of said first and second horn shaped cavities and sides of said extension layer interposed therebetween.

3. The device according to claim 2, wherein at an end of said horn antenna said first and second cavities have two or three sides and together with said first and second extension portions form said horn antenna with a six or eight sided aperture.

4. The device according to claim 3, wherein said second substrate comprises a second extension layer having first and second extension portions positioned opposite said first and second extension portions of the first extension layer, and said sides of said horn antenna include sides of said first and second extension portions of said second extension layer.

5. The device according to claim 3, wherein said first and second portions of said first extension layer extend on said top surface of said first substrate beyond said first horn shaped cavity to define a waveguide channel between said top surface of said first substrate, sides of said first and second extension portions, and said cover.

6. The device according to claim 5, wherein said second substrate comprises a second extension layer having first and second extension portions positioned opposite said first and second extension portions of the first extension layer, and said sides of said horn antenna and sides of said waveguide channel include sides of said first and second extension portions of said second extension layer.

7. The device according to claim 2, wherein said first and second portions of said first extension layer extend on said top surface of said first substrate beyond said first horn shaped cavity to define a waveguide channel between said top surface of said first substrate, sides of said first and second extension portions, and said cover.

8. The device according to claim 7, wherein said second substrate comprises a second extension layer having first and second extension portions positioned opposite said first and second extension portions of the first extension layer, and said sides of said horn antenna and sides of said waveguide channel include sides of said first and second extension portions of said second extension layer.

9. The device according to claim 8, further comprising:

at least one electronic component mounted on at least one of said first and second substrates and said first and second extension layers to transceive a millimeter or submillimeter signal via said horn antenna and said waveguide channel.

10. The device according to claim 2, wherein said second substrate comprises a second extension layer having first and second extension portions positioned opposite said first and second extension portions of the first extension layer, and said sides of said horn antenna include sides of said first and second extension portions of said second extension layer.

11. The device according to claim 1, wherein said first and second portions of said first extension layer extend on said top surface of said first substrate beyond said first horn shaped cavity to define a waveguide channel between said top surface of said first substrate, sides of said first and second extension portions, and said cover.

12. The device according to claim 11, wherein said cover comprises a second extension layer having first and second extension portions positioned opposite said first and second extension portions of the first extension layer.

13. The device according to claim 12, wherein said cover comprises a flat second substrate.

14. The device according to claim 13, wherein at an end of said horn antenna said first cavity has two or three sides and together with said first and second extension portions and said flat second substrate forms said horn antenna with a five or six sided aperture.

15. The device according to claim 11, further comprising:

at least one electronic component mounted on at least one of said first substrate, said first extension layer and said cover to transceive a millimeter or submillimeter signal via said horn antenna and said waveguide channel.

16. The device according to claim 11, wherein said cover comprises a flat second substrate.

17. The device according to claim 16, wherein at an end of said horn antenna said first cavity has two or three sides and together with said first and second extension portions and said flat second substrate forms said horn antenna with a five or six sided aperture.

18. The device according to claim 11, wherein internal surfaces of the horn antenna and waveguide channel are metalized surfaces.

19. The device according to claim 1, wherein said cover comprises a second extension layer having first and second extension portions positioned opposite said first and second extension portions of said first extension.

20. The device according to claim 1, further comprising:

at least one electronic component mounted on at least one of said first substrate, said first extension layer and said cover to transceive a millimeter or submillimeter signal via said horn antenna.

21. The device according to claim 1, wherein said cover comprises a flat second substrate.

22. The device according to claim 21, wherein at an end of said horn antenna said first cavity has two or three sides and together with said first and second extension portions and said flat second substrate forms said horn antenna with a five or six sided aperture.

23. The device according to claim 1, wherein internal surfaces of the horn antenna are metalized surfaces.

24. A method of fabricating a millimeter or submillimeter wavelength device, comprising the steps of:

providing a first substrate having a horn shaped cavity formed in a top surface of the first substrate;

forming a first extension layer having first and second extension portions formed on the top surface of the first substrate adjacent at least a portion of edges of said first horn shaped cavity; and positioning a cover opposite said first substrate to define a horn antenna having side walls including sides of said first horn shaped cavity, sides of said first and second extension portions of said first extension layer and said cover.

25. The method according to claim 24, wherein said step of positioning a cover comprises:

providing a cover comprising a second substrate having at least one second horn shaped cavity, which is a mirror image of the first horn shaped cavity, formed in a top surface of the second substrate; and disposing the second horn shaped cavity opposite the first horn shaped cavity with said first and second extension portions interposed therebetween to form said horn antenna having sides including sides of said first and second horn shaped cavities and sides of said extension layer.

26. The method according to claim 25, wherein said step of providing said first substrate comprises:

providing a substrate having two or three sides at an end thereof so that when said second substrate is disposed opposite said first horn shaped cavity with said first and second extension layers interposed therebetween, said horn antenna is formed with a six or eight sided aperture.

27. The method according to claim 26, wherein step of providing said first substrate comprises:

providing said first substrate with said first and second portions of said first extension layer extending on said top surface beyond said first cavity to define a waveguide channel between said top surface of said first substrate, sides of said first and second extension portions and said second substrate.

28. The method according to claim 27, wherein said second substrate comprises a second extension layer having first and second extension portions positioned opposite said first and second extension portions of the first extension layer, and positioning of said second substrate results in said sides of said horn antenna and sides of said waveguide channel including sides of said first and second extension portions of said second extension layer.

29. The method according to claim 26, wherein said step of positioning said cover comprises:

providing a second substrate including a second extension layer having first and second extension portions and positioning the first and second extension portions of said second extension layer opposite said first and second extension portions of the first extension layer.

30. The method according to claim 25, wherein step of providing said first substrate comprises:

providing said first substrate with said first and second portions of said first extension layer extending on said top surface beyond said first cavity to define a waveguide channel between said top surface of said first substrate, sides of said first and second extension portions and said second substrate.

31. The method according to claim 30, wherein said second substrate comprises a second extension layer having first and second extension portions positioned opposite said first and second extension portions of the first extension layer, and positioning of said second substrate results in said sides of said horn antenna and sides of said waveguide channel including sides of said first and second extension portions of said second extension layer.

32. The method according to claim 31, further comprising:

mounting at least one electronic component on at least one of said first substrate, said first extension layer and said cover to transceive a millimeter or submillimeter signal via said horn antenna and said waveguide channel.

33. The method according to claim 31, wherein said step of positioning said cover comprises providing as said cover a flat second substrate.

34. The method according to claim 33, wherein at an end of said horn antenna said first cavity has two or three sides and said step of positioning of said flat second substrate forms said horn antenna with a five or six sided aperture.

35. The method according to claim 25, wherein said step of positioning said cover comprises:

providing a second substrate including a second extension layer having first and second extension portions and positioning the first and second extension portions of said second extension layer opposite said first and second extension portions of the first extension layer.

36. The method according to claim 24, wherein step of providing said first substrate comprises:

providing said first substrate with said first and second portions of said first extension layer extending on said top surface beyond said first cavity to define a waveguide channel between said top surface of said first substrate, sides of said first and second extension portions and said cover.

37. The method according to claim 36, further comprising:

mounting at least one electronic component on at least one of said first substrate, said first extension layer and said cover to transceive a millimeter or submillimeter signal via said horn antenna and said waveguide channel.

38. The method according to claim 36 wherein said step of positioning said cover comprises:

providing a cover including a second extension layer having first and second extension portions and positioning said first and second extension portions of said second extension layer opposite said first and second extension portions of the first extension layer.

39. The method according to claim 36, wherein said step of positioning said cover comprises providing as said cover a flat second substrate.

40. The method according to claim 39, wherein at an end of said horn antenna said first cavity has two or three sides and said step of positioning of said flat second substrate forms said horn antenna with a five or six sided aperture.

41. The method according to claim 36 further comprising:

metalizing internal surfaces of said horn antenna and said waveguide channel.

42. The method according to claim 36, wherein said step of providing said first substrate comprises:

depositing a resist layer on said top surface of said substrate and in said first cavity;

photolithographically removing said resist layer from said first cavity while retaining resist layer adjacent at least a portion of said edges of said cavity, with the retained resist layer forming said first extension layer; and photolithographically removing said resist in a portion of said resist layer extending from said first cavity and beyond said first cavity with the sides of the retained resist layer forming sides of said waveguide channel in communication with said horn antenna.

43. The method according to claim 42, comprising:

metalizing internal surfaces of said horn antenna and said waveguide channel.

44. The method according to claim 42, wherein said step of depositing a resist layer comprises:

depositing a resist layer comprising EPON SU-8.

45. The method according to claim 24, wherein said step of positioning said cover comprises:

providing a cover including a second extension layer having first and second cover extension portions and positioning the first and second extension portions of said second extension layer opposite said first and second extension portions of the first extension layer.

46. The method according to claim 24 further comprising:

mounting at least one electronic component on at least one of said first substrate, said first extension layer and said cover to transceive a millimeter or submillimeter signal via said horn antenna.

47. The method according to claim 24, wherein said step of positioning said cover comprises providing as said cover a flat second substrate.

48. The method according to claim 47, wherein at an end of said horn antenna said first cavity has two or three sides and said step of positioning of said flat second substrate forms said horn antenna with a five or six sided aperture.

49. The method according to claims 24, further comprising:

metalizing internal surfaces of the horn antenna.

50. The method according to claim 24, wherein said step of providing said first substrate comprises:

depositing a resist layer on said top surface of said substrate and in said first cavity; and photolithographically removing said resist layer from said first cavity while retaining resist layer adjacent at least a portion of said edges of said cavity, with the retained resist layer forming said first extension layer.

51. The method according to claim 50, wherein said step of depositing a resist layer comprises:

depositing a resist layer comprising EPON SU-8.

52. The method according to claim 50, further comprising:

metalizing internal surfaces of the horn antenna.

* * * * *